US008646548B2

(12) United States Patent
Wells et al.

(10) Patent No.: US 8,646,548 B2
(45) **Date of Patent: *Feb. 11, 2014**

(54) APPARATUS AND SYSTEM TO ALLOW TOOL PASSAGE AHEAD OF A BIT

(75) Inventors: Peter Wells, Houston, TX (US); Jon Macrae, Houston, TX (US)

(73) Assignee: ThruBit, LLC, Katy, TX (US)

( * ) Notice: Subject to any disclaimer, the term of this patent is extended or adjusted under 35 U.S.C. 154(b) by 572 days.

This patent is subject to a terminal disclaimer.

(21) Appl. No.: 12/878,589

(22) Filed: Sep. 9, 2010

(65) Prior Publication Data

US 2011/0011579 A1 Jan. 20, 2011

Related U.S. Application Data

(63) Continuation-in-part of application No. 12/204,937, filed on Sep. 5, 2008, now Pat. No. 7,841,400.

(51) Int. Cl.
*E21B 10/62* (2006.01)
*E21B 23/02* (2006.01)

(52) U.S. Cl.
USPC ..... 175/57; 175/257; 175/322; 166/242.6

(58) Field of Classification Search
USPC ..... 166/242.6, 242.7; 175/57, 257, 262, 175/283, 322, 432
See application file for complete search history.

(56) References Cited

U.S. PATENT DOCUMENTS 2,719,363 A * 10/1955 Montgomery et al. ..... 33/544.3
2,726,848 A * 12/1955 Montgomery et al. ..... 175/321
5,472,057 A 12/1995 Winfree
5,568,838 A 10/1996 Struthers et al.
6,269,891 B1 8/2001 Runia
6,454,024 B1 * 9/2002 Nackerud ..... 175/57
6,523,624 B1 * 2/2003 Cousins et al. ..... 175/386
7,281,592 B2 * 10/2007 Runia et al. ..... 175/57
7,681,642 B2 * 3/2010 Bell et al. ..... 166/254.2
7,913,775 B2 * 3/2011 Jeffryes et al. ..... 175/58
8,141,634 B2 * 3/2012 Fisher et al. ..... 166/250.13
2004/0118611 A1 * 6/2004 Runia et al. ..... 175/57
2005/0029017 A1 * 2/2005 Berkheimer et al. ..... 175/320
2006/0118298 A1 * 6/2006 Millar et al. ..... 166/242.7
2008/0066905 A1 3/2008 Aivalis et al.
2008/0173481 A1 7/2008 Menezes et al.
2010/0059290 A1 3/2010 Wells et al.

OTHER PUBLICATIONS

Schlumberger Oilfield Glossary entry for "running tool", accessed Aug. 29, 2013 via www.glossary.oilfield.slb.com.*

PCT International Search Report and Written Opinion dated May 21, 2012 for PCT Application No. PCT/US2011/050512 filed Sep. 6, 2011.

Invitation to Pay Additional Fees dated Mar. 19, 2012 for PCT Application No. PCT/US2011/050512 filed Sep. 6, 2011.

Examination Report for Application No. 2009/14242 dated Nov. 27, 2012.

* cited by examiner

*Primary Examiner* — Daniel P Stephenson
*Assistant Examiner* — Blake Michener
(74) *Attorney, Agent, or Firm* — Chamberlain Hrdlicka

(57) ABSTRACT

Drill bits enable the use of tools in a wellbore when it is undesirable or impossible to remove the drill bit. Drill bits include a drill bit insert, a latch assembly, a housing, a running tool, and a shaft trigger to operate the latch assembly.

20 Claims, 7 Drawing Sheets

APPARATUS AND SYSTEM TO ALLOW TOOL PASSAGE AHEAD OF A BIT

CROSS-REFERENCE TO RELATED APPLICATIONS

This application is a continuation-in-part of prior U.S. patent application Ser. No. 12/204,937, filed 5 Sep. 2008 and entitled Apparatus and System to Allow Tool Passage Ahead of Bit, hereby incorporated herein by reference for all purposes.

STATEMENT REGARDING FEDERALLY-SPONSORED RESEARCH OR DEVELOPMENT

Not applicable.

BACKGROUND

The invention relates generally to the field of drilling wellbores through subterranean formations. More specifically, the invention relates to devices capable of inserting instruments through drill bits used to perform certain operations in subterranean formations below the drill bit.

During wellbore drilling operation, it is occasionally desirable to perform operations other than actual drilling into the formation. For instance, when drilling into a fractured or porous zone, it may be desirable to cure losses and to maintain formation strength by injecting cement and/or lost circulation material into the formation. Another example is setting a cement plug for abandonment of a well or well section, possibly followed by drilling of a branched well section. These non-drilling operations occur during the construction of a wellbore or borehole, but typically involve the use of well tools other than a drill bit. Using a drill bit for such non-drilling operations would be undesirable because, for example, attempting to pump a fluid of high density or viscosity and/or including coarse material through the drill string with a drill bit attached has been found to be detrimental. This is because conventional drill bits such as polycrystalline diamond cutter (PDC) bits or roller cone bits are provided with bit nozzles for discharging fluid from within a drill string into the wellbore. Such fluids create a substantial risk for the nozzles to plug up due to the high shear, rapid pressure drop, and small orifices. Nozzles normally comprise a nozzle channel with a nozzle insert, and the orifice could in principle be increased by removing the nozzle inserts from the bit. This option is however not seriously contemplated in practice because it would significantly impair the performance of the bit for progressing into the formation. Other operations such as setting a cement plug may simply not be possible with a drill bit and may require other tools.

Therefore, the drill bit is typically removed from the drill string and is replaced by a suitable tool to perform non-drilling operations. For example, when injecting fluids, a tool is used with a sufficiently large orifice in order that fluid can be introduced. This most often means that the drill string is pulled from the borehole. Before pulling the drill string out of the borehole, it is often necessary to first temporarily stabilize the borehole by introducing lost circulation material. This stabilization may often be accomplished through ports in the lower part if the drill string above the drill bit that can be opened and closed again, for example in a circulating sub. Introducing lost circulation material via the circulating sub can plug the annulus between the borehole wall and the lower part of the drill string including the drill bit, so as to require removal of the entire drill string, which may further complicate operations. The pumping of cement through the same ports is not a practical option, as a significant risk exists that the lower part of the drill string including the drill bit could be cemented in place. When the drill string then has been fully removed, the drill bit may be replaced by a cementing stinger. When the drill string is lowered again in the borehole to the desired depth, fluid can be introduced into the borehole. If further drilling is desired, the drill string must then be pulled from the borehole hole, so that the drill bit can be remounted.

Most procedures that involve removing the drill bit from the borehole are time-consuming and therefore often quite expensive. Typically, to remove the drill bit from the borehole, the drill string must be withdrawn from the borehole, the pipe string disassembled, then the pipe string reassembled and the drill string run back into the borehole. The foregoing process may take several hours or more depending on the depth of the borehole, among other factors. Moreover, removing the drill bit and drill string from an unstable borehole may result in borehole collapse. In these situations, it may be undesirable to remove the drill string from the borehole.

Other applications for inserting an instrument through a drill bit include the use of "well logging" devices. Well logging devices include one or more sensors for measuring one or more physical parameters of the formations outside the wellbore and/or various parameters of the wellbore itself such as geodetic trajectory. The sensors are disposed in a housing configured to move along the interior of the wellbore. In certain cases, it is difficult to insert well logging instruments into portions of the wellbore due to, for example, high inclination of the wellbore from vertical or rough surface of the wellbore wall. In such cases it is desirable to dispose the drill string within such portions to provide a conduit or passage for the well logging instrument. The instrument may be exposed to the open wellbore by opening a passage in the drill bit, such as by removing a releasable insert, and moving the instrument through the opening.

Previous devices to address the needs described above include providing a drill bit insert in the drill bit which is held in place by means of a ball-latch mechanism, detaching the drill bit insert through the use of a tool inserted into the drill string which is configured to unlatch the ball-latch mechanism, and deploying the tool through the opening in the drill bit created by removing the insert from the bit body. After completion of the task, the tool is then retracted and drill bit insert reattached to the drill bit by means of re-latching the ball-latch mechanism. The drilling activity could then recommence. However, in the foregoing drill bits with inserts, the tool used to disengage the latching mechanism may result in incomplete or misaligned attempts at unlatching the latching mechanism, or worse, unintentional release of the insert from the drill bit without its positive connection to the release tool. In such cases, the insert could unintentionally fall to the bottom of the well, resulting in a difficult and expensive operation to retrieve the insert desired.

Accordingly, there exists a need for a drill bit and release tool or "running tool" that address one or more disadvantages of the prior art.

SUMMARY

A drill bit in one aspect of the invention includes a drill bit body defining an opening enabling longitudinal passage of an instrument therethrough, a drill bit insert disposed in the opening and a latch assembly coupled to the insert and configured to releasably retain the insert in the opening. The latch assembly may be configured to operate upon locking engagement therewith of a running tool. The latch assembly may also be operable to release the insert from the opening in response to axial and rotational force applied to the latch assembly. The latch assembly may also be disposed in a substantially sealed enclosure.

A running tool in another aspect of the invention is configured to operate a latch assembly only upon locking engagement therewith. The running tool includes a running tool housing with a circumference and a longitudinal axis, a drive shaft extending along longitudinal axis of the running tool and including an outer circumference, and a mating assembly enclosed within the running tool housing and configured to lockably engage the latch assembly. The running tool further includes a shaft trigger assembly, wherein the shaft trigger assembly is enclosed within the running tool housing and the shaft trigger assembly is configured to substantially prevent rotational movement of the drive shaft and a torsion spring. The torsion spring is mechanically connected to the drive shaft and configured to motivate the drive shaft to rotate.

Other aspects and advantages of the invention will be apparent from the following description and the appended claims.

BRIEF DESCRIPTION OF THE DRAWINGS

A more complete understanding of the present disclosure and possible advantages thereof may be acquired by referring to the following description taken in conjunction with the accompanying figures, wherein.

DETAILED DESCRIPTION OF THE EMBODIMENTS

Figure 1A:
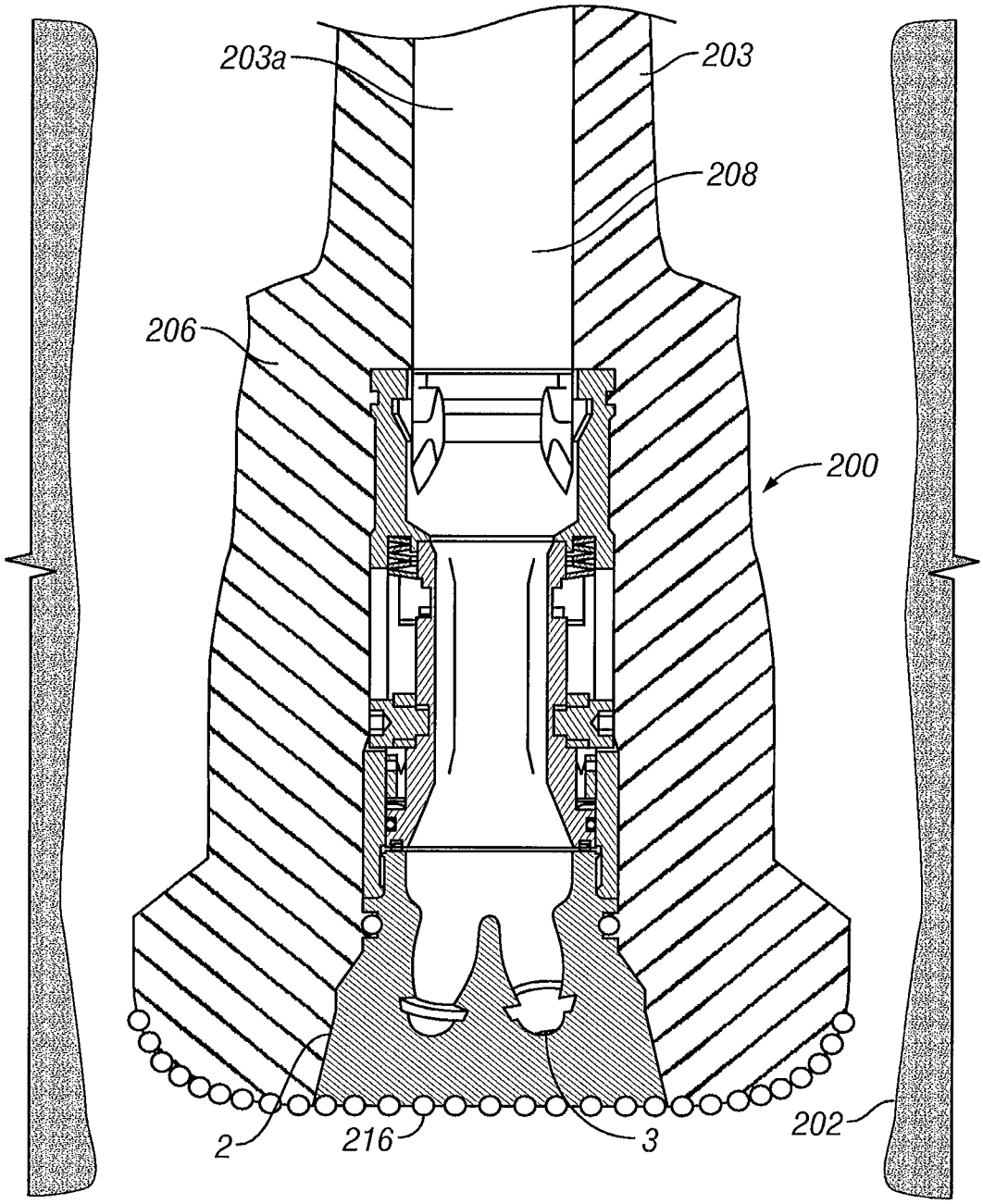
FIG. 1A shows schematically a drill bit in accordance with one example of the present invention.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the scope of the invention as defined by the appended claims. While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

The invention enables the use of tools in a wellbore when it is undesirable or impossible to remove the drill bit. Examples of devices used in a wellbore when it is undesirable or impossible to remove the drill bit are disclosed in U.S. Pat. No. 7,287,609, filed Nov. 13, 2003, entitled "Drilling a Borehole," and U.S. Pat. No. 7,281,592, filed Jul. 23, 2002, entitled "Injecting a Fluid into a Borehole Ahead of the Bit."

As used herein, the term "upper" refers to a position or orientation relatively closer to the surface end of the drill string and the term "lower" is used to mean a position relatively closer to the subsurface end of the borehole during operation. The term "longitudinal" is used to refer to a direction or orientation substantially along the axis of the drill string.

FIG. 1A shows schematically a longitudinal cross-section of a rotary drill bit consistent with the present invention. Drill bit (200) is shown in borehole (202) and is attached to lower end of a pipe or conduit, which may be a drill string (203), at the upper end of bit body (206). Drill bit insert (2) is disposed in bit body opening (212). Bit body (206) of drill bit (200) includes central longitudinal passageway (208) which allows fluid communication and passage of a tool between the interior of the drill string (203*a*) through latch fluid passageway (214) of drill bit insert (2) to borehole (202) exterior to drill bit (200). Drill bit insert (2) is shown with cutting elements (216), although cutting elements are not required to be included on the insert (2). Also depicted are nozzles (3), although other examples of the insert (2) may exclude nozzles. As shown in FIG. 1C, bit body (206) further includes bit body groove (210) disposed at an upper end of the passageway (208). Bit body groove (210) is configured to releasably retain collet latch (24) as described below.

Figure 1B:
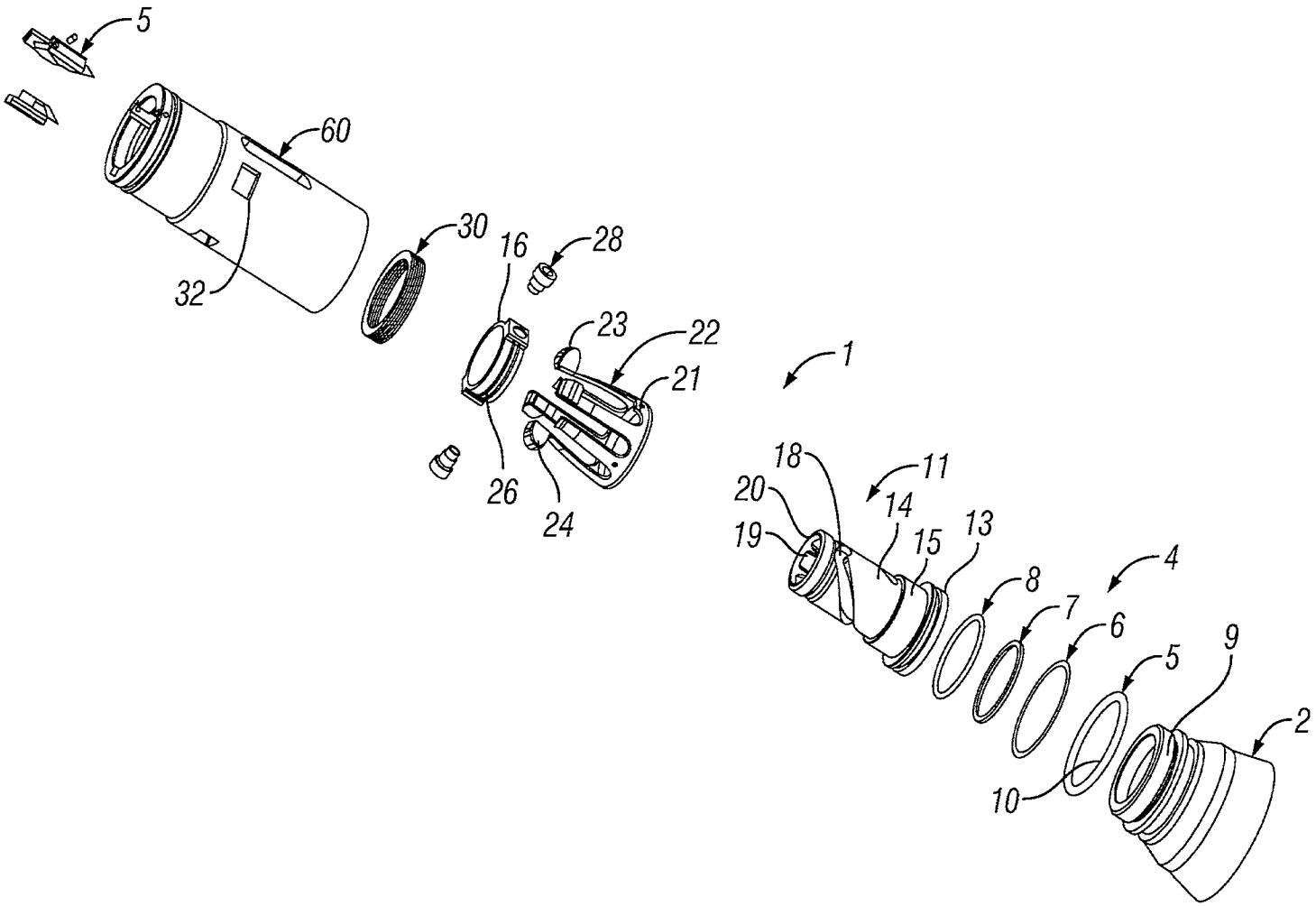
FIG. 1B shows an exploded view of a latch assembly in one example of the present invention.
Figure 1C:
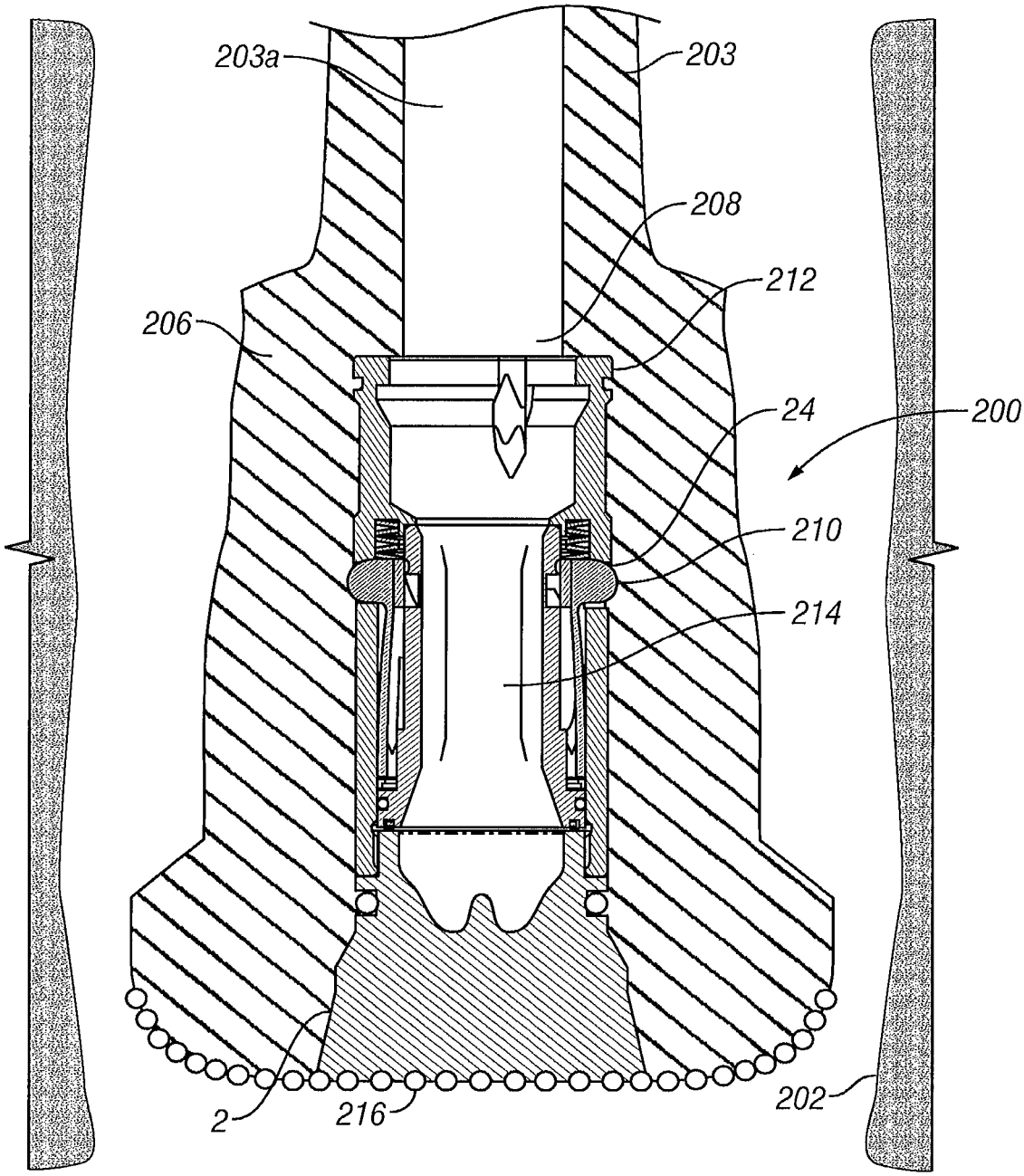
FIG. 1C shows schematically a drill bit in accordance with one example of the present invention.

FIG. 1B is an exploded view of the latch assembly (1). As described further below, latch assembly (1) is configured to enable releasable coupling of the insert (2) to the bit body (206) to allow passage of a particular tool, such as a cementing tool, well logging tool or survey tool, through drill string (203) and into borehole (202).

Figure 3:
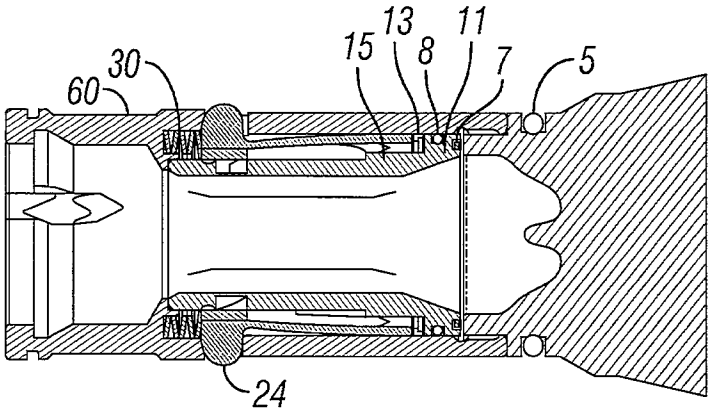
FIG. 3 shows a cross-sectional view of the latch assembly in the latched position in one example of the present invention.
Figure 4:
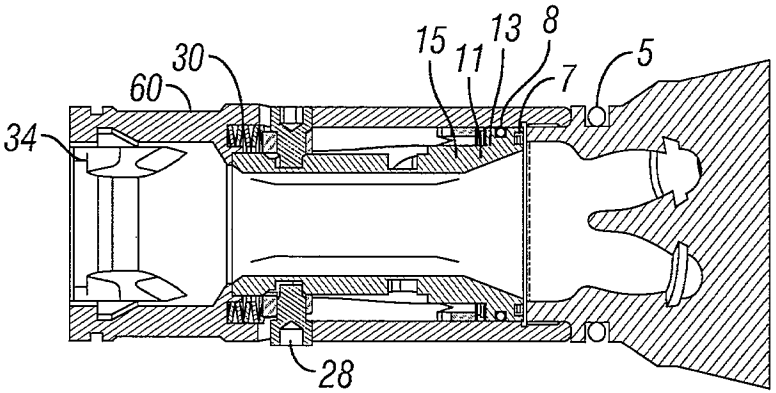
FIG. 4 shows a cross-sectional view of the latch assembly in the latched position in one example of the present invention.

Latch assembly (1) is mechanically connected (for example, by threads) to drill bit insert (2) to allow retention of the insert (2) in the bit body (206 in FIG. 1A) until it is to be released therefrom, and includes optional seal elements (4), cam (11) and collet assembly (22). Optional seal elements (4), which may be excluded, act to substantially prevent fluids within the interior of the drill string, such as drilling mud, from entering latch assembly (1) through any gaps that may exist between drill bit insert (2) and cam (11). Optional seal elements (4) are depicted in FIGS. 1, 3, and 4 as including lower O-ring (5), shim (6), rotary seal (7), and upper O-ring (8). Inner circumferential surface (10) of lower O-ring (5) is configured to circumferentially engage the outside circumferential surface (9) of bit insert (2). Shim (6) and rotary seal (7) are disposed between bit insert (2) and cam (11). Upper O-ring (8) is disposed about the circumference of cam (11) as shown in FIGS. 4, 5, 6, and 7. Lower O-ring (5) and upper O-ring (8) may be composed of any suitable material. One non-limiting example of a suitable material is Buna-N rubber. As one of ordinary skill in the art will appreciate, the makeup of seal elements (4) is non-limiting and other seal element configurations are within the scope of the present invention.

As shown in FIGS. 3, 4, 5, and 6, cam (11) seats against drill bit insert (2). Cam (11) includes cam body (14) and cam ring (16). Cam body (14) is shown here as generally cylindrical. Cam body (14) includes cam shoulder (13) which circumferentially extends about the outer surface of cam body (14); cam shoulder (13) is configured to facilitate a seal in conjunction with optional upper O-ring (8) between cam (11) and housing (60) as shown in FIGS. 3, 4, 5 and 6. Cam body (14) further includes cylindrical ledge (15), a raised section of cam body designed to engage collet assembly (22) as described below. Disposed about the exterior surface of cam body (14) are one or more generally helical slots (18). In one embodiment of the present invention, generally helical slots (18) are "J-slots", as shown in FIG. 1B. Helical slots (18) shown in FIG. 1B extend from proximate top edge (20) of cam body (14) to proximate cylindrical ledge (15). Helical slots (18) may vary in helical length as is necessary to accomplish their function (as described below). Within cam body (14) and extending longitudinally along the inner surface (12) of cam body (14) are splines (19).

Collet assembly (22) includes collet ring (21) and collet keys (23). As shown in FIGS. 3, 4, 5, and 6, collet assembly (22) is configured so as to circumferentially engage cylindrical ledge (15), with the lower surface of collect ring (21) juxtaposed against cam shoulder (13) and the inner surface collet ring (21) engaging the outer surface of cylindrical ledge (15). Collet keys (23) extend from the upper surface of collet ring (21). As further shown in FIG. 1B, each of the collet keys (23) includes collet latch (24).

Cam (11) further includes cam ring (16). Cam ring (16) concentrically contained within the collet keys (23) of collet assembly (22) so that in the engaged position the collet keys (23) are extended to lock the latch assembly (1) within the drill bit. Cam ring (16) further includes cam latch pins (28). Cam latch pins (28) project through cam ring (16) and are disposed so as to engage helical slots (18) on cam body (14) when cam ring (16) is concentrically positioned within the collet assembly (22).

FIG. 1B further shows spring (30). Spring (30) is juxtaposed on the upper surface of cam ring (16) and biases cam ring (16) towards drill bit insert (2). When helical slots (18) are J-slots, spring (30) acts to bias cam latch pins in hook portion of the J-slot.

Latch assembly (1) is positioned within housing (60). Housing (60) is generally cylindrical and is configured to protect latch assembly (1) from drilling mud and other wellbore fluids by forming a substantially sealed enclosure around latch assembly (1). Housing (60) is mechanically connected to bit insert (2), typically by threading housing (60) to bit insert (2), although one of ordinary skill in the art will understand alternative methods of mechanically connecting housing (60) to bit insert (2).

As shown in FIG. 1B, housing (60) further includes one or more apertures (32). Apertures (32) are situated along the circumference wall of housing (60) and are configured such that collet latches (24) protrude through apertures (32) when latch assembly (1) is in the latched position.

As shown in FIGS. 1C, 3 and 4, when in the latched position, collet latches (24) protrude though apertures (26) and mechanically engage bit body groove (210) of bit body (206) so as to releasably retain collet latches (24) in bit body groove (210). When so engaged, cam latch pins (28) project through cam ring (16) and engage helical slots (18) on cam body (14). When helical slots (18) are J-slots, spring (30) acts to bias cam latch pins in hook portion of the J-slot. Spring (30), collet (22), and cam (11) are all positioned within housing (60). Further, when in the latched position, the inner surface (12) of cam body (14) defines latch fluid passageway (214). Latch fluid passageway is configured to pass various fluids including drilling mud from central longitudinal passageway (208) to borehole (202) exterior to drill bit (200)

Figure 7:
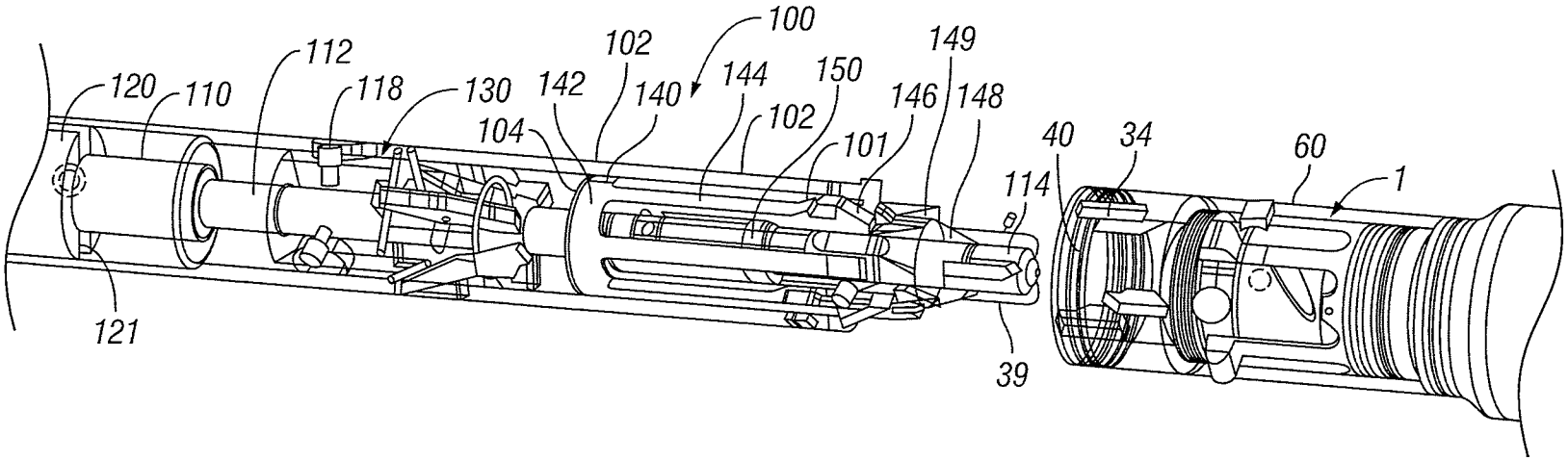
FIG. 7 shows an exploded view of the running tool in accordance with one example of the present invention.

As shown in FIG. 7, housing (60) further includes inner diameter groove (40). Inner diameter groove (40) extends circumferentially about the inner diameter of housing (60). Situated within inner diameter groove (40) are one or more alignment keys (34). Alignment keys (34) are positioned along the inner circumferential surface of housing (60) and are configured to properly align and rotationally fix running tool (100) to latch assembly (1), as further described below.

Figure 7A:
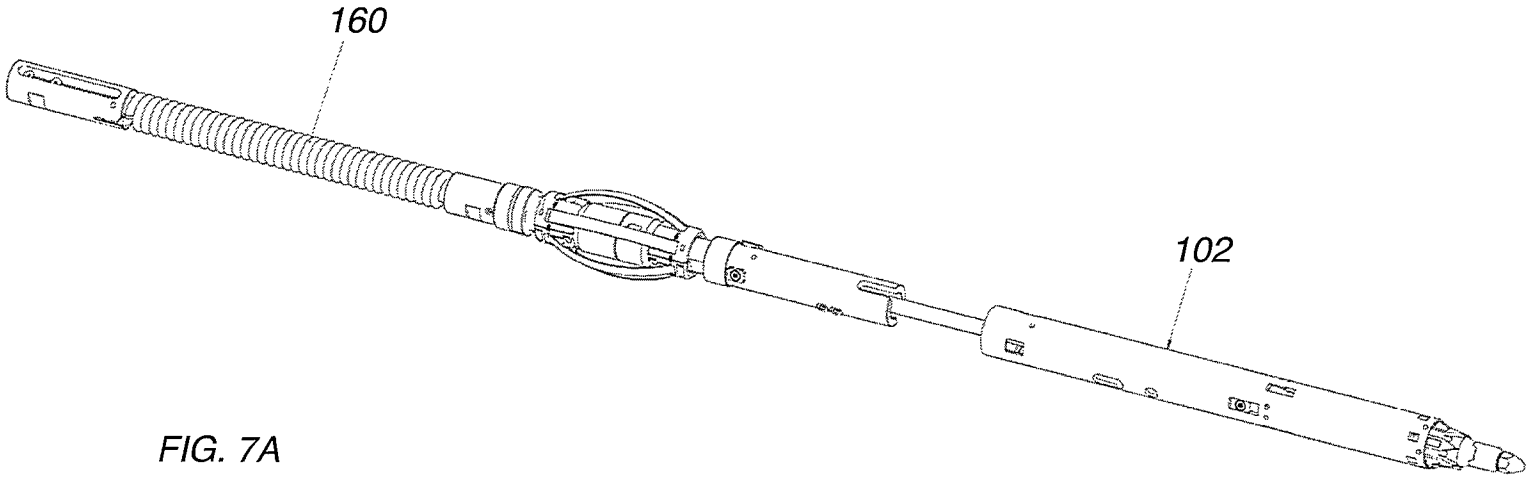
FIG. 7A shows a perspective view of the running tool in accordance with one example of the present invention.

Running tool (100) is shown in FIGS. 7 and 7A and includes mating assembly (101), drive shaft (110), shaft trigger assembly (130), running tool housing (102), torsion spring (160). Running tool (100) is configured to traverse central longitudinal passageway (208).

Running tool housing (102) is approximately cylindrical and encloses mating assembly (101), drive shaft (110), shaft trigger assembly (130) and torsion spring (160) and is configured to protect these elements from drilling mud and other fluids that may exist within central longitudinal passageway (208).

Drive shaft (110) is aligned along the longitudinal axis of running tool housing (100) and circumferentially encompassed by running tool housing (102). Drive shaft (110) includes shaft (112) and shaft head (114). Shaft head (114) is mechanically connected to drive shaft (110) and is configured to rotate with rotation of shaft (112). Shaft head (114) includes shaft head splines (39).

Mating assembly (101) as shown is configured to engage running tool (100) with latch assembly (1). Mating assembly (101) includes upper collet assembly (140), upper collet support ring (150), and collet body (148) with guide slots (149). Upper collet support ring (150) circumferentially encloses and is mechanically connected to drive shaft (110). Upper collet assembly (140) includes upper collet frame (142), a ring that is configured to circumferentially enclosing drive shaft (110) such that drive shaft (110) can rotate and pass longitudinally therethrough, and upper collet keys (144), which extend from the upper surface of upper collet frame (142). The inner diameter of upper collet frame is larger than the outer diameter of upper collet support ring (150); therefore, upper collet support ring (150) is configured so as to be capable of longitudinally passing through upper collet frame (142). Upper collet keys (144) are prevented from contacting the surface of drive shaft (110) by upper collet support ring (150) when drive shaft (110) passes longitudinally therethrough.

Upper collet (140) is seated against a ledge in the collet body (148). The collet body is mated to the Shaft Trigger assembly (130) so that the collet (140), collet body (148) and Shaft Trigger assembly (130) are able to move axially as a single unit within the Running tool Housing (102). The collet (140) is configured so that it is held in engaged in the running tool housing (102) and as such restrains the Shaft Trigger assembly (130) and collet body (148) until such time as it is activated by engagement with the latch assembly (1) as described below. Rotational translation by upper collet (140) within running tool housing (102) is substantially prevented by mechanical contact between the outer diameter of upper collet frame (142) and the inner diameter of running tool housing (102).

FIG. 7 further shows guide slots (149). Guide slots (149) extend approximately perpendicularly from the inner surface of the collet body (148) and are configured to mechanically engage alignment keys (34), thereby lockably engaging running tool (100) to latch assembly (1). Thus, when guide slots (148) and alignment keys (34) are mechanically engaged, running tool assembly (100) and latch assembly (1) are aligned and rotationally fixed. Further, when running tool (100) is lockably engaged to latch assembly (1), splines (19) and shaft head splines (39) are aligned to allow mechanical engagement. Splines (19) and shaft head splines (39) will not properly engage unless latch assembly (1) is lockably engaged to running tool (100) by mating assembly (101).

Upper collet keys further include upper collet key latch mechanisms (146). Upper collet key latch mechanisms (146) are configured so as to mechanically engage inner diameter groove (40) of housing (60). When mechanically engaged, inner diameter groove (40) longitudinally fixes running tool (100) with respect to latch mechanism (1). Upper collet mechanisms (146) and inner diameter groove (40) will not properly engage unless will not properly engage unless guide slots (149) and alignment keys (34) are mechanically engaged. The upper collet (146) is further configured so that proper engagement in the inner diameter groove (40) allows the shaft trigger assembly (130) to move axially with respect to the running tool housing (102).

Figure 2:
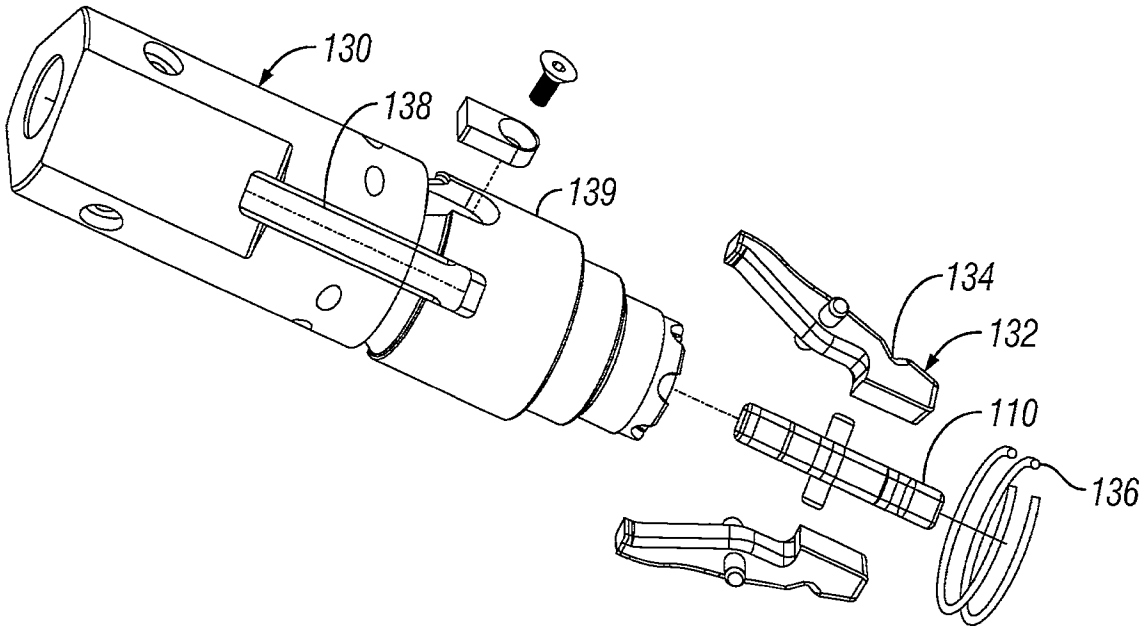
FIG. 2 shows an exploded view of the trigger assembly of one example of the present invention.

FIGS. 2 and 7 show shaft trigger assembly (130). Shaft trigger assembly (130) includes shaft trigger housing (139), which is generally cylindrical and circumferentially encloses drive shaft (110), shaft release triggers (132), key anti-rotation spring (136) and shaft pins (118). Shaft trigger assembly (130) is configured to substantially prevent axial movement of shaft (110). Pivotally attached to the outer circumference of shaft trigger housing (139) is one or more shaft release triggers (132). Each shaft release trigger includes notch (134). Key anti-rotation spring (136) is configured to fit within notch (134) and hold shaft release triggers (132) in place within the shaft trigger housing (139) so that the release triggers (132) are locked into a groove in the drive shaft (110), substantially preventing the translation of shaft 110 with respect to the trigger housing (139). Shaft trigger assembly (130) includes one or more shaft trigger grooves (138). Trigger assembly pins (118) extend from the body of the trigger assembly (130) and locate the trigger assembly rotationally within the running tool housing (102). Shaft pins (118) are further configured to allow longitudinal movement of the trigger assembly (130) within the running tool housing (102).

As shown in FIGS. 2 and 7, one or more of the Shaft Release triggers (132) extend from the outer circumference of the trigger housing (139) and protrude into slots in the running tool housing (102) so that the shaft trigger assembly (130) can be allowed to move axially within the running tool housing (102). Shaft release triggers (132) are further configured so that upon longitudinal movement of the shaft trigger assembly (130), the shaft release triggers (132) will engage the running tool housing (102).

As further shown in FIGS. 7 and 7A, torsion spring (160) is wound about shaft (112) in compression and is prevented from rotating while the shaft roller bearings (120) reside within the bearing housing slot (121). Torsion spring (160) is substantially prevented from rotating shaft (110) until the shafts move axially shaft release triggers have been engaged by the running tool housing (102) as described below.

Figure 5:
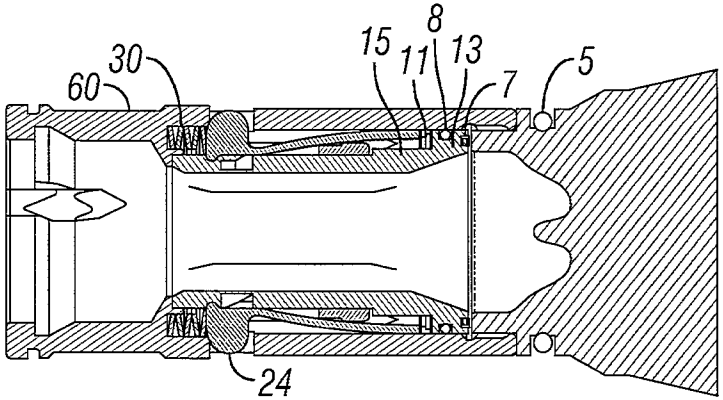
FIG. 5 shows a cross-sectional view of the latch assembly in the unlatched position in one example of the present invention.
Figure 6:
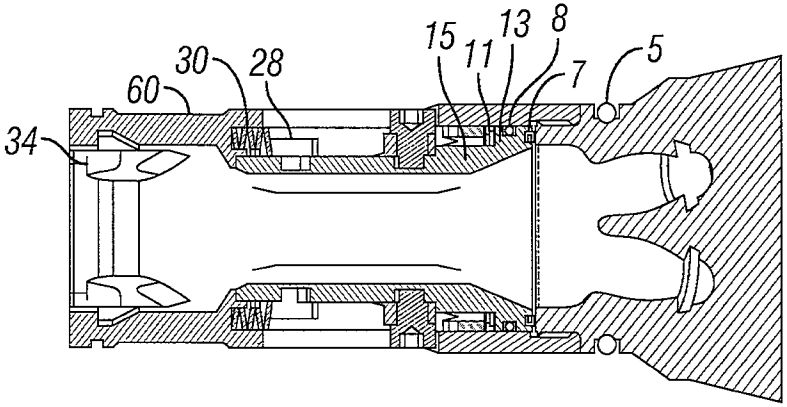
FIG. 6 shows a cross-sectional view of the latch assembly in the unlatched position in one example of the present invention.

To unlatch and move latch assembly (1) to the unlatched position as shown in FIGS. 5 and 6, running tool (100) is translated along central longitudinal passageway (208). Running tool (100) is mated with latch assembly (1) as described above by mechanically engaging guide pins (148) and alignment keys (34). Trigger assembly (139) and drive shaft (110) are longitudinally translated through running tool (100). Shaft release triggers (132) traverse shaft trigger grooves to engage running tool housing (102). Shaft triggers (132) pivot to release drive shaft (110). When the drive shaft (110) moves forward to where the shaft roller bearings are no longer engaged in the roller bearing housing, and this allows drive shaft (110) to rotate about its axis. Torsion spring (160) then causes drive shaft (110) to rotate. Shaft head splines rotationally translate splines (19), causing cam body (14) to rotate. The rotation of cam body (14) causes cam latch pins (28) and cam ring (16) to translate along helical slots (18). The translation of the cam ring (16) causes it to disengage from the collet keys (23) allowing the keys (23) to retract, thereby disengaging collet latch (24) from the bit body (206). The combination of gravity and longitudinal pressure exerted by drive shaft (110) on cam (11) moves the latch assembly (1) to the unlatched position as shown in FIGS. 5 and 6.

Upon moving latch assembly (1) to the unlatched position, latch assembly (1) may be pushed longitudinally along borehole (202) by mechanical pressure applied by drive shaft (110). In this way, latch assembly (1) may be completely disengaged from bit body (206), allowing drive shaft head (114) to longitudinally traverse the interior of housing (60). When disengaged, latch assembly (1) with insert attached (2) may be moved out from the bit body (206) enabling passage of the running tool and any instrument coupled to the running tool to be moved into the wellbore through the passage in the bit body. Typically, the tool, instrument and/or the running tool will include a "no-go" or similar device having a size larger than the diameter of the passage (210) in the bit body so that the instrument will be suspended by the drill string in the open wellbore below the drill bit. The instrument may be moved along the interior of the wellbore, for example, by withdrawing the drill string from the wellbore.

The examples disclosed herein have generally been described in the context of a subsea installation. One of ordinary skill in the art with the benefit of this disclosure will appreciate that examples of the present invention would be suitable for surface and land-based installation. Additionally, it is explicitly recognized that any of the features and elements of the examples disclosed herein may be combined with or used in conjunction with any of the examples disclosed herein.

The particular examples disclosed above are illustrative only, as the present invention may be modified and practiced in different but equivalent manners apparent to those skilled in the art having the benefit of the foregoing disclosure. Furthermore, no limitations are intended to the details of construction or design herein shown, other than as described in the claims below. It is therefore evident that the particular illustrative examples disclosed above may be altered or modified and all such variations are considered within the scope of the present invention, as defined only by the claims appended hereto. Also, the terms in the appended claims have their plain, ordinary meaning unless otherwise explicitly and clearly defined herein.

What is claimed is:

1. A drill bit, including:

a drill bit body including an opening;

an insert disposed in the opening; and a latch assembly including a longitudinal axis in line with the opening and coupled to the insert, the latch assembly configured to releasably retain the insert in the opening and being operable to release the insert from the opening in response to an axial and a rotational force applied to the latch assembly in the direction of and about the longitudinal axis, respectively;

where the latch assembly is configured to operate only upon locking engagement with a running tool.

2. The drill bit according to claim 1 further including:

a housing mechanically engaging the drill bit insert, where the housing is substantially cylindrical, and includes apertures disposed on an outside circumference; and where the latch assembly is disposed within the housing.

3. The drill bit according to claim 2, wherein the latch assembly includes:

a cam including a cam body with an outer surface and an inner surface, and where a helical slot is disposed on the outer surface of the cam body;

a collet assembly that circumferentially encloses the cam body and further comprises collet keys configured to protrude through the apertures; and a cam ring concentrically positioned around the collet keys, where the cam ring includes a cam latch pin that engages the helical slot of the cam body.

4. The drill bit of claim 3, where the helical slot is a J-slot that includes a hook portion.

5. The drill bit of claim 4 further including a spring placed against the cam ring and configured to bias the cam latch pin into the hook portion of the J-slot.

6. The drill bit of claim 3, wherein at least one of the collet keys further includes a collet latch configured to mechanically engage one of the apertures of the housing.

7. The drill bit of claim 6, where the drill bit body further includes a bit body groove configured to releasably retain the collet latch.

8. The drill bit of claim 3 where the cam further includes splines extending longitudinally along the inner surface of the cam body.

9. The drill bit of claim 2, where the housing further includes:

an inner diameter groove extending circumferentially about an inner diameter of the housing; and an alignment key disposed within the inner diameter groove.

10. The drill bit of claim 1, where the latch assembly is disposed in a substantially sealed enclosure.

11. A running tool configured to operate a latch assembly, including:

a running tool housing with a circumference and a longitudinal axis;

a drive shaft extending along the longitudinal axis of the running tool and with an outer circumference;

a mating assembly enclosed within the running tool housing and configured to lockably engage the latch assembly;

a shaft trigger assembly enclosed within the running tool housing and configured to substantially prevent rotational movement of the drive shaft;

a torsion spring mechanically connected to the drive shaft and configured to motivate the drive shaft to rotate; and where the running tool is configured to operate the latch assembly only upon locking engagement with the latch assembly.

12. A system for drilling a well bore comprising:

a drill bit including:

a body including an opening allowing an instrument to pass through the body;

an insert disposed in the opening; and a latch assembly coupled to the insert and configured to releasably retain the insert in the opening, the latch assembly operable to release the insert from the opening in response to axial and rotational force applied to the latch assembly; and a running tool configured to operate the latch assembly, including:

a running tool housing;

a drive shaft extending along the running tool;

a mating assembly enclosed within the running tool housing and configured to engage the latch assembly;

a shaft trigger assembly enclosed within the running tool housing and configured to substantially prevent rotational movement of the drive shaft; and a torsion spring mechanically connected to the drive shaft and configured to motivate the drive shaft to rotate.

13. The drill bit according to claim 12, wherein the latch assembly includes:

a cam including a cam body with an outer surface and an inner surface, and where a helical slot is disposed on the outer surface of the cam body;

a collet assembly that circumferentially encloses the cam body and further comprises collet keys; and a cam ring concentrically positioned around the collet keys, where the cam ring includes a cam latch pin that engages the helical slot of the cam body.

14. The system of claim 12, where the latch assembly is disposed in a substantially sealed enclosure.

15. The drill bit of claim 12, where the latch assembly is configured to operate only upon locking engagement with the running tool.

16. A method of drilling and performing operations in a well bore including:

drilling the well bore with a drill bit including an insert disposed in an opening through the drill bit and held in place with a latch assembly, the latch assembly including a longitudinal axis in line with the opening;

running a running tool into the well bore and into engagement with the latch assembly;

releasing the insert by applying an axial and a rotational force with the running tool to the latch assembly in the direction of and about the longitudinal axis, respectively;

removing the insert from the opening using the running tool; and passing an instrument through the drill bit opening to perform an operation.

17. The method of claim 16 further including substantially sealing the opening while the insert is disposed in the opening.

18. The method of claim 16 further including locking the running tool to the latch assembly.

19. The method of claim 16 further including:

replacing the insert in the opening; and detaching the running tool from the latch assembly.

20. The method of claim 19, further including withdrawing the running tool from the well bore and continuing drilling.

* * * * *